US006507962B2

(12) United States Patent
Thurston

(10) Patent No.: US 6,507,962 B2
(45) Date of Patent: Jan. 21, 2003

(54) CEILING MOUNTED SLEEPING SYSTEM

(76) Inventor: J. Andrew Thurston, 209 Glenwood Ave., Atlanta, GA (US) 30312

( * ) Notice: Subject to any disclaimer, the term of this patent is extended or adjusted under 35 U.S.C. 154(b) by 0 days.

(21) Appl. No.: 09/867,160

(22) Filed: May 29, 2001

(65) Prior Publication Data

US 2002/0178497 A1 Dec. 5, 2002

(51) Int. Cl.[7] ..... A47C 17/84
(52) U.S. Cl. ..... 5/10.1; 5/10.2; 5/312
(58) Field of Search ..... 5/10.1, 10.2, 85.1, 5/312

(56) References Cited

U.S. PATENT DOCUMENTS 1,197,035 A * 9/1916 Knudtson et al. ..... 5/10.2
2,632,183 A 3/1953 Patton
2,730,213 A 1/1956 Mason
2,968,048 A 1/1961 Roberge
3,327,328 A * 6/1967 Silvoski ..... 5/181
3,665,527 A 5/1972 Gonzalez
4,034,518 A * 7/1977 Trecker ..... 190/11
4,059,960 A 11/1977 Daidone
5,377,787 A 1/1995 Chabrier
5,943,714 A 8/1999 Dignam
5,984,404 A * 11/1999 Novoa et al. ..... 296/190.01

* cited by examiner

*Primary Examiner*—Michael F. Trettel
(74) *Attorney, Agent, or Firm*—Technoprop Colton LLC

(57) ABSTRACT

A bed platform and winch system having a sleeping platform for supporting a mattress, a ceiling support attached to the ceiling and having a winch contained therein, and wires connecting the winch to the sleeping platform and extending through the ceiling support, such that the sleeping platform may be raised out of the way when not needed for sleeping and lowered when needed for sleeping.

20 Claims, 6 Drawing Sheets

CEILING MOUNTED SLEEPING SYSTEM

BACKGROUND OF THE INVENTION

1. Technical Field

The technical field of the present invention is, generally, sleeping systems and, more specifically, sleeping systems comprising a sleeping platform that can be hidden or stowed out of the way when not in use.

2. Prior Art

Sleeping systems are as old as the Earth. From quiet corners in the primordial soup to nesting sites in the crotches between tree branches to leaf beds in caves to master bedroom suites in the most exclusive of suburban subdivisions, all manners of creatures have developed places to rest and recharge. As far as humans are concerned, the variety of sleeping systems is as large as the variety of habitats, ranging in location from small one-room apartments in the middle of large cities to large bedrooms in single-family homes, and ranging in size from small single person futons to large extra-king-size beds.

In many habitats, floor space is at a premium, and a bed that takes up space when not in use is an unneeded luxury. Various sleeping systems have been developed to maximize floor space or to convert sleeping areas to living areas. For example, trundle beds convert a single bed to two single beds or a double bed, and can be stowed when not in use, increasing floor space. Futons and convertible sofa beds are opened up a night to provide a bed and are closed during the day to provide sifting areas. Murphy beds are folded down from the wall at night to provide a bed and are folded up into the wall during the day to increase floor space. Further, various devices have been developed to lift a bed up against or into the ceiling when not in use to provide increased floor space.

U.S. Pat. No. 2,632,183 to Patton discloses a vertically displaceable bed platform that is suspended by a cable attached to the ceiling and runs on rails attached to the wall. Although the '183 invention discloses an elevating sleeping platform, it is not fully mounted to the ceiling, requiring sidewall rails.

U.S. Pat. No. 2,730,213 to Mason discloses a hoist for lifting a bed platform with an attached cable at each corner to hoist the bed with an electric motor. The '213 invention has the lifting mechanism mounted above the ceiling and the bed is lifted into the ceiling. In this regard, the '213 invention is relatively complex when compared to the present invention, and requires substantial preparation or reconstruction of the ceiling to accommodate the sleeping platform within the ceiling.

U.S. Pat. No. 2,968,048 to Roberge discloses a hoist for lifting a bed platform with an attached cable at each corner to hoist the bed with an electric motor. The '048 invention has the lifting mechanism mounted above or within the ceiling and the bed is lifted into the ceiling. So, the '048 invention has similarities to the '213 invention, is much more complex than the present invention, and also requires substantial preparation or reconstruction of the ceiling to accommodate the sleeping platform within the ceiling.

U.S. Pat. No. 3,665,527 to Gonzalez discloses a structure for supporting a bed for movement between a non-use ceiling storage position and a floor use position. The '527 invention uses hollow pillars comprising cables, pulleys and counterweights to move the bed from the floor to the ceiling and vice versa. Because of the four pillars, the '527 invention is not a space saving as is the present invention.

U.S. Pat. No. 4,058,860 to Daidone discloses a suspended bed platform having winches that are operated by an electric motor that is operator actuated. The '860 patent mounts the winch on the bottom of the platform and uses pulleys and cables to raise and lower the platform. Thus, the winch mechanism is exposed and extends downward into the room, affecting the headroom within the room.

U.S. Pat. No. 5,377,787 to Chabrier discloses a vertically displaceable bed platform that is suspended from the ceiling via a pulley system that uses a counterweight. The device has three pillars to place against the wall and a cable system for the fourth corner extending into the room. The platform moves up and down using a counterweight system visible between the pillars and within the room.

U.S. Pat. No. 5,943,714 to Dignam discloses a vertically displaceable bed platform that is suspended from the ceiling via a pulley system that uses a counterweight. The '714 invention uses a series of telescoping brace members and a counterweight with pulleys to raise and lower the bed. The '714 invention requires substantial preparation or reconstruction of the walls to accommodate the counterweight system.

Thus, it can be seen that there exists a need for a ceiling mounted sleep system that is simple in construction and requires little modification, preparation and reconstruction to the existing ceiling and walls of the room in which the system is mounted. It is to this need that the present invention is directed.

BRIEF SUMMARY OF THE INVENTION

The present invention is a bed platform and winch system that allows one to raise a bed to the ceiling when not in use (to move it out of the way in a small room or loft-style apartment) and to lower the bed to the floor when in use, as shown in the attached drawing. The system comprises a sleeping platform, a ceiling support or winch assembly, wires, and a winch.

The sleeping platform typically is a steel platform for supporting a mattress, futon or the like. The platform can be of any common mattress size. The ceiling support or winch assembly is an "H"-shaped component mounted to the ceiling by mounting brackets and typically is made of tubular steel. The length of each of the sides of the "H" is approximately the length of a common mattress. The width of the central portion or cross-member of the "H" typically is the width of the selected mattress size.

A winch mechanism is contained within the central portion or cross-member of the "H" of the ceiling support or winch assembly. The winch is connected to several wires that run from the winch through the central portion or cross-member of the "H" of the ceiling support or winch assembly to the respective legs of the sides of the "H", and then down to the sleeping platform. Various pulleys contained within the "H" allow the wires to run smoothly and quietly.

In use, the sleeping platform is lowered to its lowermost desired position (typically on the floor to prevent swinging). A mattress or other bedding is placed on the sleeping platform, and the user can sleep on the mattress. When it is desired to raise the bed, the user activates the winch, which winds the wires, thus raising the sleeping platform. The sleeping platform can be raised as close to the ceiling as desired. When it is desired to lower the bed once again, the user activates the winch in the reverse direction, which unwinds the wires, thus lowering the sleeping platform.

It is an object of the present invention to provide a sleeping system that maximizes the amount of space within a room during the non-sleeping time periods.

It is another object of the present invention to provide a sleeping system suitable for use in small rooms, small apartments or lofts, or single room living quarters.

It is another object of the present invention to provide a sleeping system that is easily installed into an existing structure, or can be installed as original equipment in a new structure.

It is another object of the present invention to provide a sleeping system that provides a recoupable investment in a structure as an installed fixture.

It is another object of the present invention to provide a sleeping system that has a space-saving design and can be lowered over existing furniture.

It is another object of the present invention to provide a sleeping system that can be operated using conventional electrical wiring or can be remote controlled by electromagnetic waves, such as infrared or radio waves.

These objects, and other objects, features and advantages of the present invention will become more apparent to those of ordinary skill in the art when the following detailed description of the preferred embodiments is read in conjunction with the attached drawings.

DETAILED DESCRIPTION OF THE PREFERRED EMBODIMENTS

Referring to the appended FIGS., the invention is a bed platform and winch system that allows one to raise a bed to the ceiling when not in use (to move it out of the way in a small room or loft-style apartment) and to lower the bed to the floor when in use.

Figure 1:
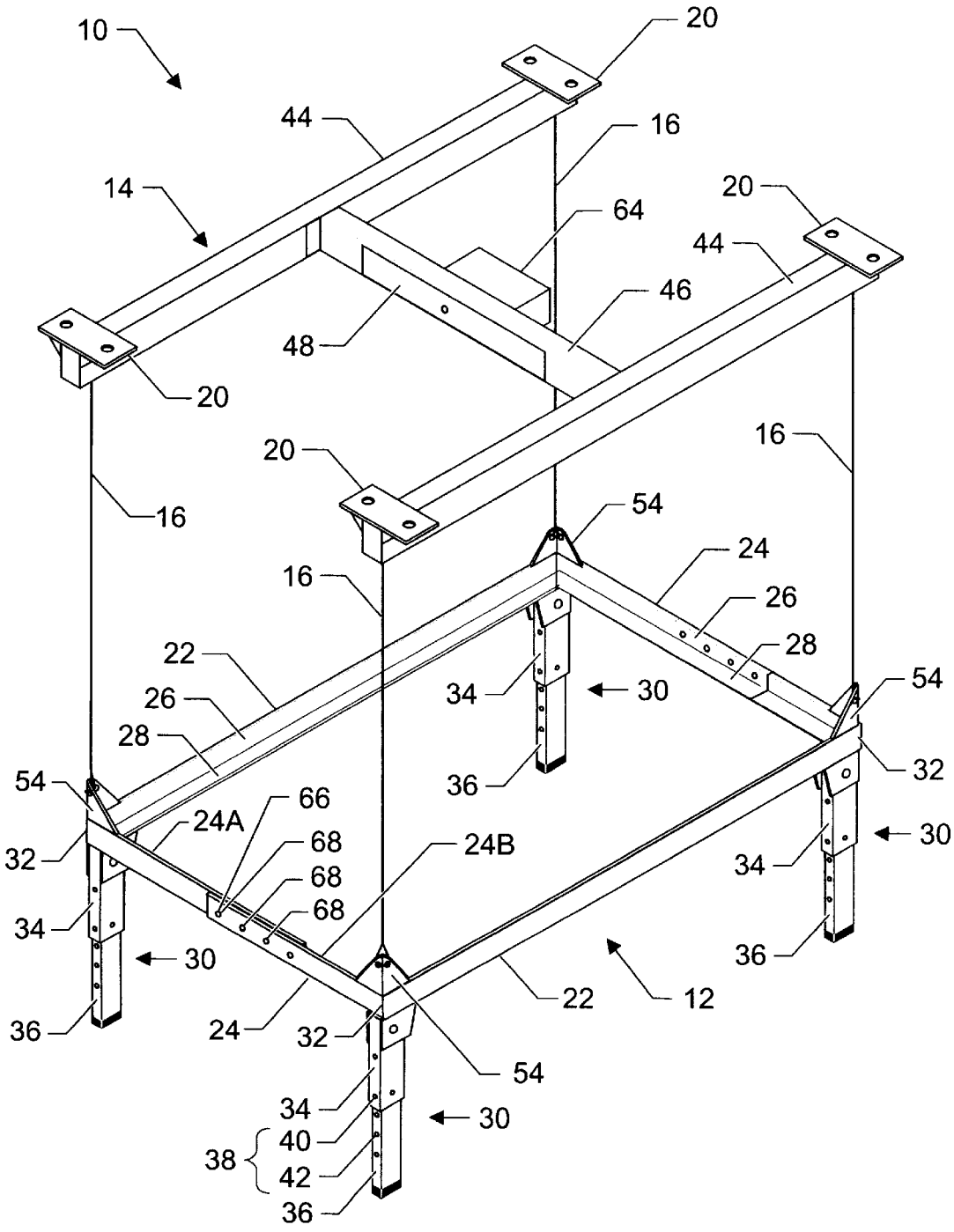
FIG. 1 is a perspective view of a preferred embodiment of the present invention.

Referring now to FIG. 1, which shows the invention in its operating position, the system 10 comprises a sleeping platform 12, a ceiling support 14, connection and translation means such as wires 16 and a winch contained in a winch housing 64 to wind the wires 16. The sleeping platform 12 typically is a strong, relatively rigid platform for supporting a mattress, futon or the like. The sleeping platform 12 can be of any common mattress size. The ceiling support 14 is a generally "H" -shaped component mounted to the ceiling by mounting brackets 20 and typically also is a strong, relatively rigid structure. Sleeping platform 12 and ceiling support 14 are two separate structures connected by wires 16.

Sleeping platform 12 has a structure similar to a common bed frame. In more detail, sleeping platform comprises side rails 22 and end rails 24 connected so as to form a generally rectangular structure of the same relative size as the mattress or other sleeping palette to be placed on the sleeping platform 12. Each of the side rails 22 and end rails 24 preferably are "L"-channels, or comprise "L"-shaped portions, having a vertical component 26 and a horizontal component 28. The vertical components 26 assist in containing the mattress within the sleeping platform 12. The horizontal components 28 assist in supporting the mattress on the sleeping platform.

Sleeping platform 12 further comprises legs 30 to support the sleeping platform 12 on the floor. Legs 30 preferably are located at the four corners 32 of the sleeping platform 12, but may be located at any positions that provide adequate support for the sleeping platform. As shown in FIG. 1, legs 30 can comprise a pivoting section 34 and a telescoping section 36. Telescoping section 36 slides up and down within pivoting section 34 so as to make the height the sleeping platform 12 is supported above the floor selectively variable. Locks 38, such as spring lock buttons 40 cooperating with one or more holes 42, lock telescoping section 36 at the desired height within pivoting section 34. Pivoting section 34 pivots relative to side rails 22 and/or end rails 24. As discussed in more detail below with reference to FIG. 5 and FIG. 6, legs 30 can pivot downward to be in a vertical position when the sleeping platform 12 is in the sleeping position, to support the sleeping platform 12 on the floor, and can be pivoted upward to be in a horizontal position when the sleeping platform 12 is in the storage position, to be out of the way.

Ceiling support 14 is a generally "H"-shaped structure comprising generally parallel side tubes 44 connected generally centrally by cross tube 46. A mounting bracket 20 is located at each end of side tubes 44 for mounting ceiling support 14 to the ceiling. Winch housing 64 is attached to cross tube 46 and is accessible by one or more access panels 48. Side tubes 44 and cross tube 46 are hollow, providing a track for wires 16 to travel from the winch, and through the cross tube 46 and side tubes 44 until wires 16 exit the ceiling support 14.

Figure 2:
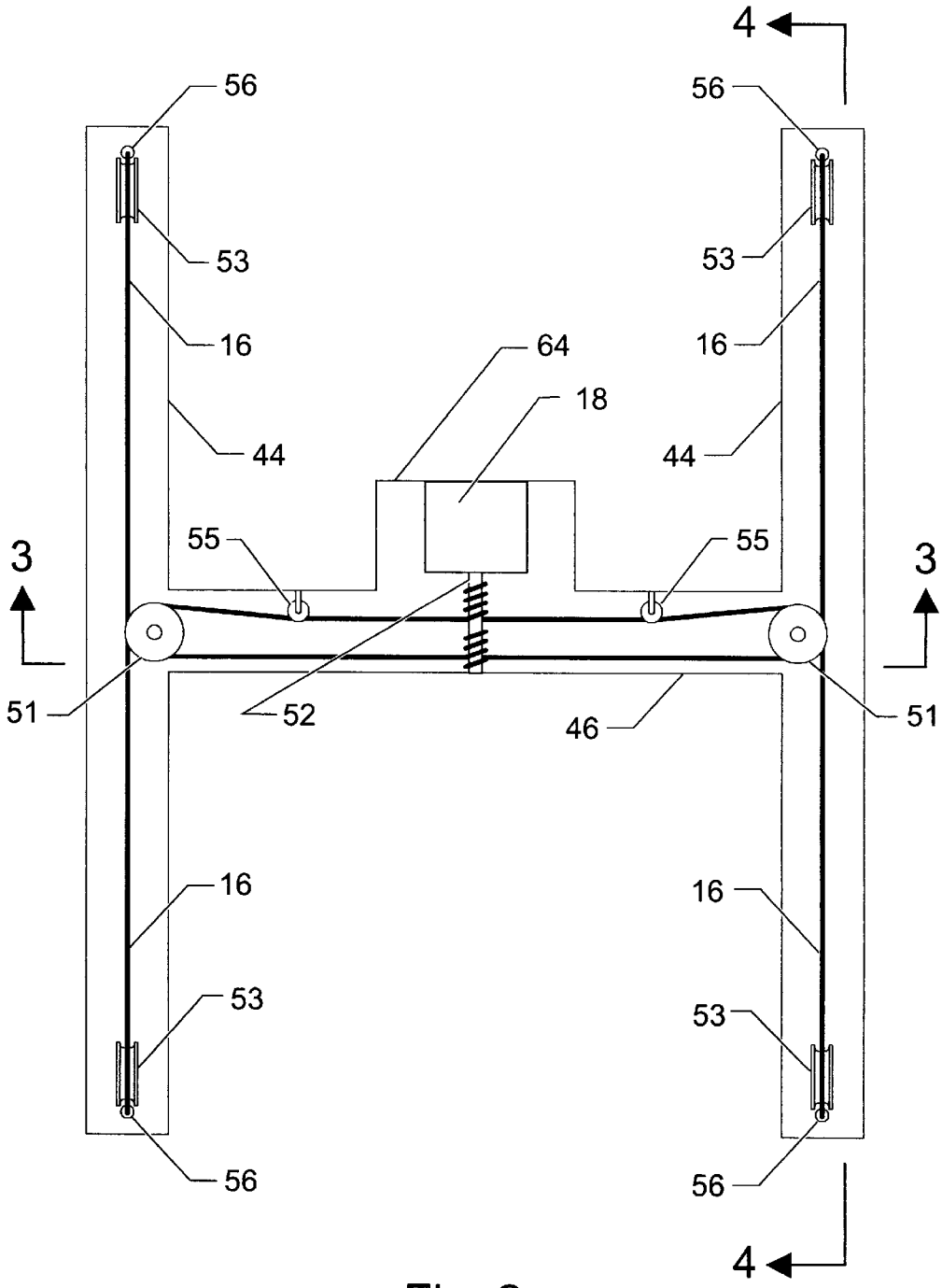
FIG. 2 is a sectional top view of the ceiling mount assembly of the present invention.

Referring now to FIG. 2, a top sectional view of the ceiling support is shown, showing in more detail the arrangement of the winching system. Side tubes 44 and cross tube 46 cooperate with each other to provide a continuous track from the winch 18 in winch housing 64 through cross tube 46 and side tubes 44 to the ends of side tubes. Winch 18 is mounted within winch housing 64. Rollers or pulleys 50 are mounted within cross tube 46 and side tubes 44. Wires 16 terminate at a first end on winch shaft 52 and terminate at a second end on attachment points 54 on sleeping platform 12. Wires 16 wind their way through cross tube 46 and side tubes 44 from winch 18 to sleeping platform 12 by cooperating with specific pulleys 53 located proximal to exit ports 56, double pulley 51, and idler pulley or roller 55, so as to travel smoothly through ceiling support 14, and exiting ceiling support 14 through exit ports 56.

Figure 3:
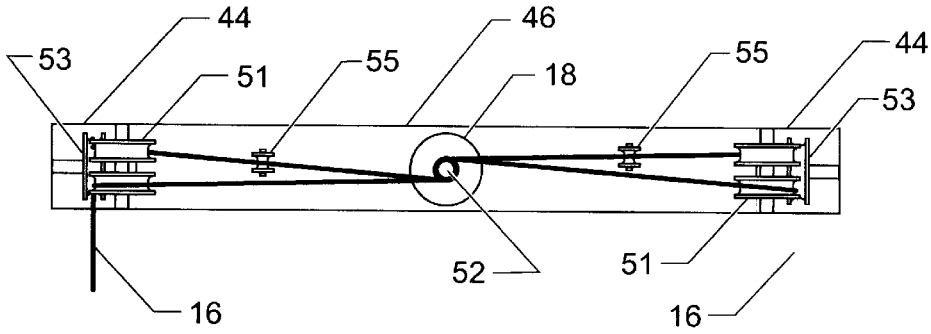
FIG. 3 is a sectional front view of the ceiling mount assembly of the present invention along line 3—3 of FIG. 2.
Figure 4:
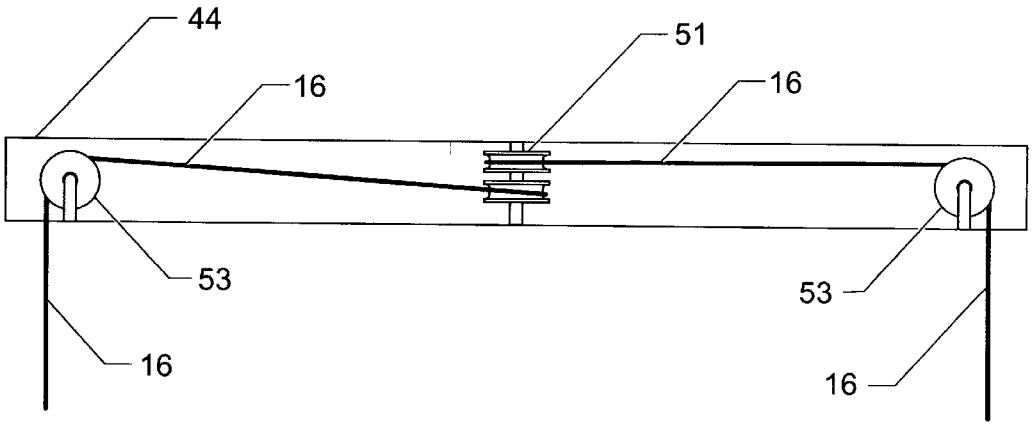
FIG. 4 is a sectional side view of the ceiling mount assembly of the present invention along line 4—4 of FIG. 2.

Referring now to FIG. 3, which shows a front sectional view of the ceiling support 14, and FIG. 4, which shows a side sectional view of ceiling support 14, the path of wires 16 through ceiling support 14 is shown in greater detail. FIG. 3 shows sets of wires 16 attached to and wound around winch shaft 52, traveling through cross tube 46 to and around double pulley 51, then traveling through side tube 44 to pulley 53, and exiting side tube 44 through exit port 56. FIG. 4 shows sets of wires 16 extending from winch 18 (not visible in FIG. 4) through cross tube 46 to and around double pulley 51, traveling through side tube 44 to pulley 53, and exiting side tube 44 through exit port 56. FIG. 3 also shows optional idler pulley or roller 55, which helps align one of wire 16 to the proper pulley of double pulley 51 and to wind properly on winch shaft 52.

Figure 5:
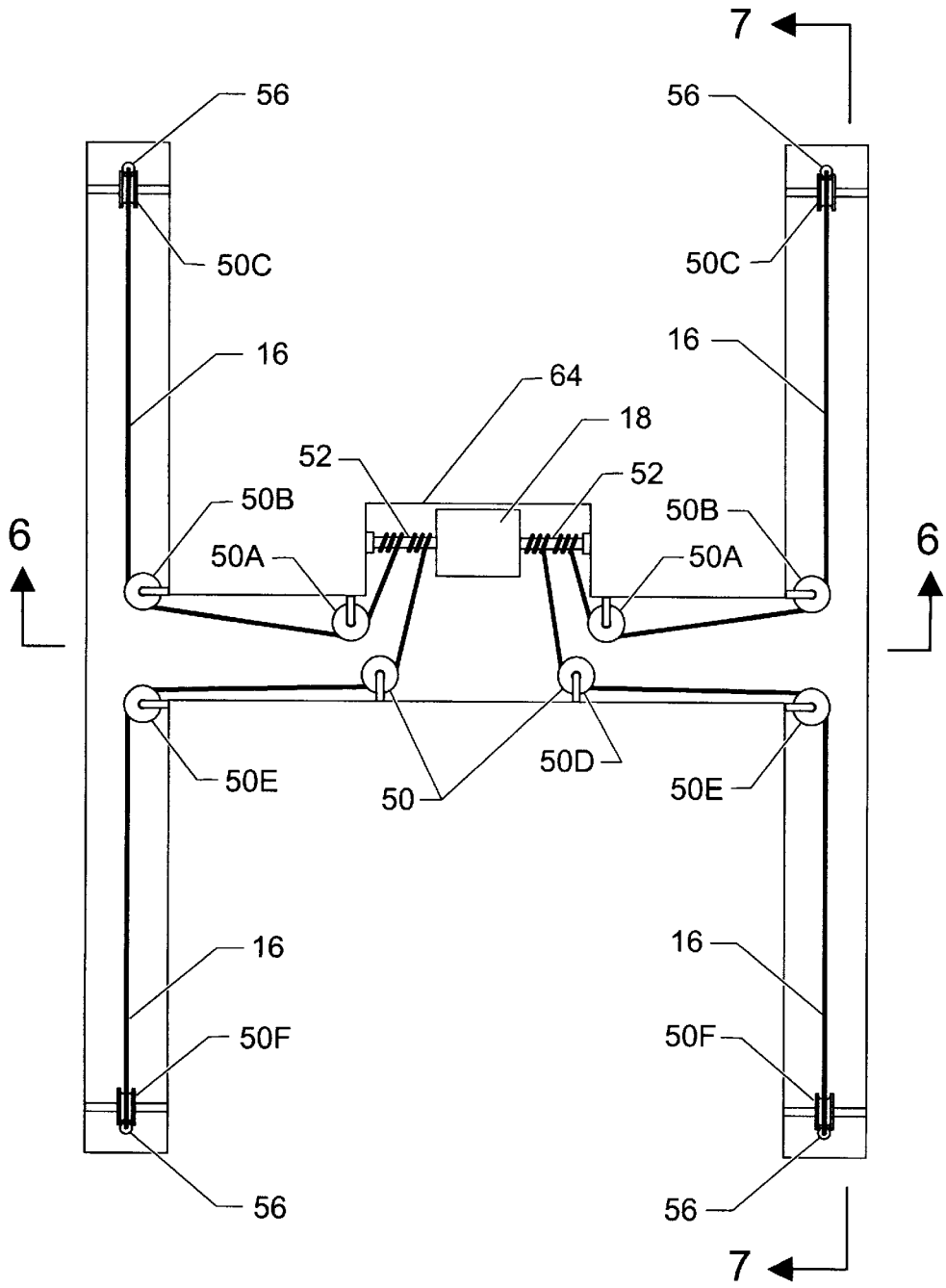
FIG. 5 is a sectional top view of an alternate embodiment of the ceiling mount assembly of the present invention.

Referring now to FIG. 5, a top sectional view of an alternate embodiment of the ceiling support is shown, showing in more detail the arrangement of the winching system. Side tubes 44 and cross tube 46 cooperate with each other to provide a continuous track from the winch 18 in winch housing 64 through cross tube 46 and side tubes 44 to the ends of side tubes. Winch 18 is mounted within winch housing 64. Rollers or pulleys 50 are mounted within cross tube 46 and side tubes 44. Wires 16 terminate at a first end on winch shaft 52 and terminate at a second end on attachment points 54 on sleeping platform 12. Wires 16 wind their way through cross tube 46 and side tubes 44 from winch 18 to sleeping platform 12 by cooperating with specific pulleys 50, so as to travel smoothly through ceiling support 14, and exiting ceiling support 14 through exit ports 56.

Figure 6:
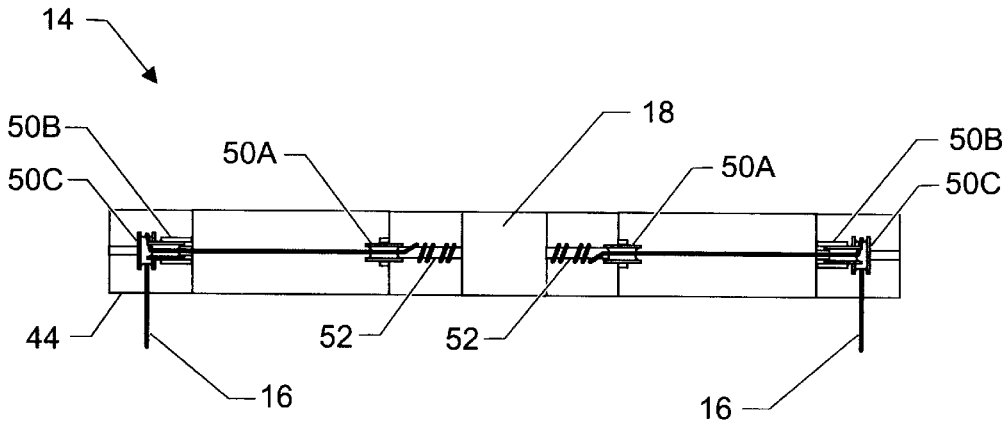
FIG. 6 is a sectional front view of the ceiling mount assembly of the present invention along line 6—6 of FIG. 5.
Figure 7:
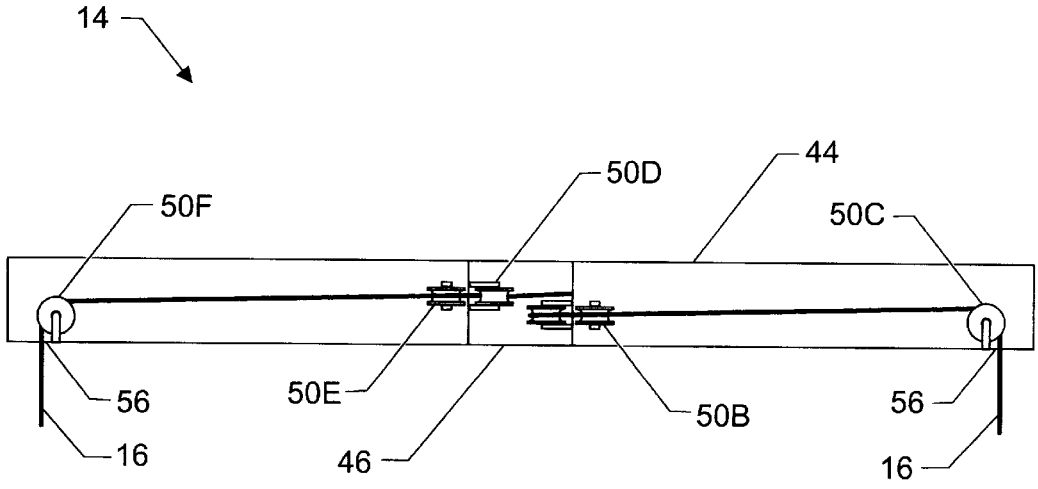
FIG. 7 is a sectional side view of the ceiling mount assembly of the present invention along line 7—7 of FIG. 5.

Referring now to FIG. 6, which shows a front sectional view of the alternate embodiment of the ceiling support 14 shown in FIG. 5, and FIG. 7, which shows a side sectional view of the alternate embodiment of the ceiling support 14 shown in FIG. 5, the path of wires 16 through ceiling support 14 is shown in greater detail. FIG. 6 shows sets of wires 16 attached to and wound around winch shaft 52, traveling around a first pulley 50A through cross tube 46 to a second pulley 50B, traveling through side tube 44 to a third pulley 50C, and exiting side tube 44 through exit port 56. FIG. 7 shows sets of wires 16 extending from winch 18 (not visible in FIG. 7) around a fourth pulley 50D through cross tube 44 to a fifth pulley 50E, traveling through side tube 44 to a sixth pulley 50F, and exiting side tube 44 through exit port 56. FIG. 7 also shows wire 16 traveling around second pulley 50B through side tube 44 to third pulley 50C, and exiting side tube 44 through exit port 56.

Figure 8:
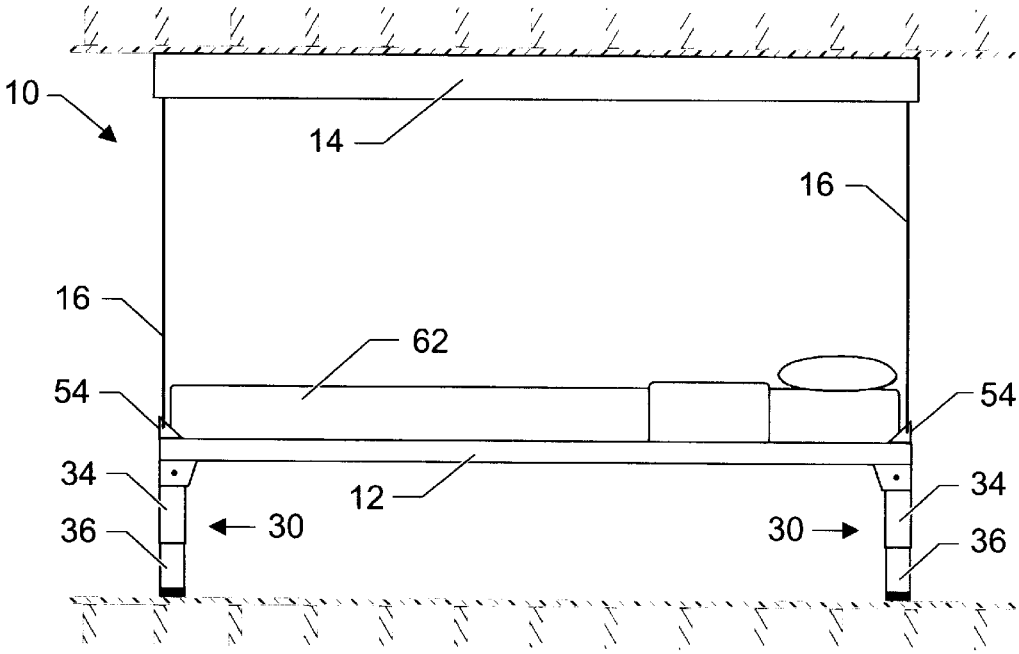
FIG. 8 is a side view of the present invention in the down or sleeping position.
Figure 9:
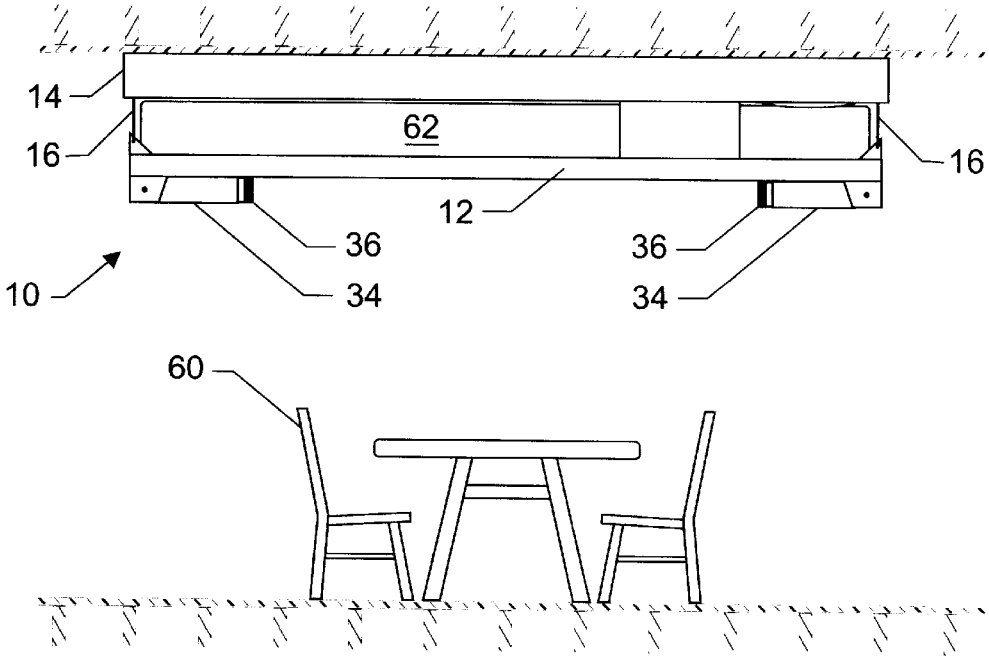
FIG. 9 is a side view of the present invention in the up or storage position.

Referring now to FIG. 8, which shows a side view of the system 10 in the down or sleeping position, and FIG. 9, which shows a side view of the system 10 in the up or storage position, one can see the operation of the system 10. Initially, sleeping platform 12 is at its lowered position in FIG. 8, with legs 30 in their downward and telescoped position touching the floor. Wires 16 are securely attached to the sleeping platform 12 to attachment points 54, as shown in more detail in FIG. 1, and travel upward into ceiling support 14. Winch 18 is activated, causing wires 16 to wind on winch shaft 52, thus lifting sleeping platform 12. Pulleys 50, 51, 53, 55 allow the smooth travel of wires 16 through ceiling support 14. When sleeping platform 12 is in the up position, winch 18 is deactivated. Telescoping sections 36 are moved upward within pivoting sections 34 to shorten the length of legs 30, and legs 30 are pivoted upward to their horizontal storage positions. With the sleeping platform 12 in the up or storage position, furniture 60 can be placed below the system 10.

Sleeping platform 12 can be a unitary frame structure made in several different sizes corresponding to the common mattress sizes, namely, single, twin, full, double, queen and king. Alternatively, as shown in FIG. 1, sleeping platform 12 can be adjustable to fit many different sized mattresses. For sleeping platform 12 to be adjustable, side rails 22 and/or end rails 24 each are two parts movable relative to each other. For example, as shown in FIG. 1, end rail 24 comprises two parts, first part 24A and second part 24B, to accommodate mattresses of different widths. First part 24A comprises the "L"-channel and two frame locking pins 66, and second part 24B comprises the "L"-channel and two or more frame locking slots 68. To accommodate a mattress of a first size, first part 24A is placed is a stacked relationship with second part 24B such that each of the two frame locking pins 66 cooperate with two of the frame locking slots 68. To accommodate a larger or smaller mattress, frame locking pins 66 are relocated to two other frame locking slots 68, either farther from corner 32 of second part 24B for a larger mattress or closer to corner 32 of second part 24B for a smaller mattress. Side rails 22 also can be of two parts to accommodate mattresses of different lengths.

Winch 18 is a device capable of winding wires 16 and lifting sleeping platform 12 from a lowered or sleeping position, as shown in FIG. 8, to a raised or storage position, as shown in FIG. 9. Selecting a properly sized and powered winch 18 is within the knowledge of those of ordinary skill in the winch art. Winch 18 can be activated by wired switches (not shown), remote controls (not shown), or other activating mechanisms known to those of ordinary skill in the relevant arts. Further, the winch activation mechanism can have switches to deactivate the winch 18 when pressure is sensed when the sleeping platform 12 touches the floor when being lowered and/or when pressure is sensed when the sleeping platform 12 or the bedding 62 touches the ceiling support. As a further safety mechanism, winch 18 can be configured not to operate when the sleeping platform 12 weighs more than a certain amount, such as when a person is on sleeping platform 12.

Thus, in use, the sleeping platform 12 is lowered to its lowermost desired position. This typically is on the floor to prevent swinging, but may be in a suspended position above the floor. A mattress or other bedding 62 is placed on the sleeping platform 12, and the user can sleep on the mattress. When it is desired to raise the bed, the user activates the winch 18, which winds the wires 16, thus raising the sleeping platform 12. The sleeping platform 12 can be raised as close to the ceiling as desired. When it is desired to lower the bed once again, the user activates the winch 18 in the reverse direction, which unwinds the wires 16, thus lowering the sleeping platform 12.

The ceiling support 14 can be a retrofit device or an original equipment device. As a retrofit device, the ceiling support is mounted to the ceiling, generally to the studs or joists in the ceiling, by using lags bolts or other bolts. The bolts are placed through mounting brackets 20 and secured to the studs or joists. Typically, one mounting bracket 20 on each end of side tubes 44 should suffice, but fewer or more mounting brackets 20 can be used as deemed necessary or appropriate.

The winch 18, wires 16 and pulleys 50, 51, 53, 55 can be accessed for service, cleaning or replacement, or if the wires come off of the pulleys 50, 51, 53, 55, through one or more access panels 48. Access panel 48 can be bolted, screwed, clipped, or otherwise attached to ceiling support 14.

The materials of manufacture for both ceiling support 14 and sleeping platform 12 are a matter of design choice known to those of ordinary skill in the art. Preferably, both ceiling support 14 and sleeping platform 12 are made of powdered coated steel for strength and aesthetics. However, either or both ceiling support 14 and sleeping platform 12 can be made of carbon fiber materials, fiberglass materials and other ceramic material; iron, aluminum, titanium and other metal materials; or high strength polymer materials. The material of manufacture for wires 16 also are a matter of design choice known to those of ordinary skill in the art. Preferably, wires 16 are made of high tensile strength steel, such as carbon steel. However, wires 16 can be made of high tensile strength, flexible ceramics, plastics and silks.

The above detailed description of the preferred embodiments and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. A ceiling mounted sleeping system comprising:

a. a fixed ceiling support structure that is mounted upon a surface of a ceiling wall; and b. a movable sleeping platform movable in vertical translation to the ceiling support structure; and c. movement means for moving the sleeping platform relative to the ceiling support structure, wherein, the movement means comprises an engine and at least one translation means connecting the engine to the sleeping platform; the ceiling support structure comprises a location for the engine and pathways for containing and guiding the at least one translation means; each of the at least one translation means comprises a first end and a second end, the first end being connected to the engine and the second end being connected to the sleeping platform; the sleeping platform comprises support means for bedding and at least one attachment means, each of the at least one attachment means being secured to the second end of each of the at least one translation means; and the sleeping platform is movable between a lowered position for sleeping and a raised position close to but not within the ceiling for storage.

2. The system as claimed in claim 1, wherein the pathways of the ceiling support structure cooperate with the at least one translation means to guide the at least one translation means from the engine to the sleeping platform.

3. The system as claimed in claim 2, wherein the ceiling support structure is disposed above the sleeping platform.

4. The system as claimed in claim 3, wherein the pathways are within the ceiling support structure, the ceiling support structure further comprises at least one exit port cooperating with the pathways to allow the at least one translation means to exit the ceiling support structure.

5. The system as claimed in claim 4, wherein each of the at least one exit port is disposed directly above the respective at least one attachment means, such that the at least one translation means secured to the respective at least one attachment means is in a vertical disposition.

6. The system as claimed in claim 1, wherein the sleeping platform further comprises a perimeter and expansion means for changing the length of the perimeter.

7. The system as claimed in claim 6, wherein the sleeping platform further comprises two side rails and two end rails connected together in a rectangular structure and four corners each of which is located at an intersection of one side rail and one end rail.

8. The system as claimed in claim 7, wherein each of the at least one attachment means is located at one of the corners.

9. The system as claimed in claim 7, wherein the sleeping platform further comprises at least one support leg located at at least one of the corners.

10. The system as claimed in claim 9, wherein the at least one support leg is pivotable relative to the sleeping platform from a vertical position normal to the sleeping platform to a horizontal position parallel to the sleeping platform.

11. The system as claimed in claim 9, wherein the at least one support leg comprises a telescoping structure allowing the at least one support leg to be adjustable in length.

12. The system as claimed in claim 1, wherein the sleeping platform further comprises at least one support leg.

13. The system as claimed in claim 1, wherein the engine is a winch and the translation means is selected from the group consisting of wires, chains, ropes, riggings, and cables.

14. The system as claimed in claim 1, wherein the engine effects the translation of the sleeping platform relative to the ceiling support structure and comprises an automatic shutoff mechanism to prevent translation of the sleeping platform more than a selected distance.

15. A ceiling mounted sleeping system comprising:

a. a fixed ceiling support structure; and b. a movable sleeping platform movable in vertical translation to the ceiling support structure; and c. movement means for moving the sleeping platform relative to the ceiling support structure, wherein, the movement means comprises an engine and at least one translation means connecting the engine to the sleeping platform; the ceiling support structure comprises a location for the engine and pathways for containing and guiding the at least one translation means and a first side tube and a second side tube, each side tube having two ends and a central body, and one cross tube having two ends and a central body, one of the two ends of the cross tube being connected to the central body of the first side tube and the second of the two ends of the cross tube being connected to the central body of the second side tube; each of the at least one translation means comprises a first end and a second end, the first end being connected to the engine and the second end being connected to the sleeping platform; and the sleeping platform comprises support means for bedding and at least one attachment means, each of the at least one attachment means being secured to the second end of each of the at least one translation means.

16. The system as claimed in claim 15, wherein the first side tube, the second side tube and the cross tube are in the same plane.

17. The system as claimed in claim 15, wherein each of the first side tube, the second side tube and the cross tube are hollow, and comprise an interior surrounded by a wall forming the pathways between and through the cross tube and the first side tube and between and through the cross tube and the second side tube.

18. The system as claimed in claim 17, wherein the interior is provided with at least one roller for guiding the at least one translation means through the interior such that the at least one guide means is prevented from touching the wall to any great extent.

19. A ceiling mounted sleeping system comprising:

a. a fixed ceiling support structure; and b. a movable sleeping platform movable in vertical translation to the ceiling support structure; and c. movement means for moving the sleeping platform relative to the ceiling support structure, wherein, the movement means comprises an engine and at least one translation means connecting the engine to the sleeping platform; the ceiling support structure comprises a location for the engine, pathways within the ceiling support structure for containing and guiding the at least one translation means, a first side tube and a second side tube, each side tube having two ends and a central body, and one cross tube having two ends and a central body, one of the two ends of the cross tube being connected to the central body of the first side tube and the second of the two ends of the cross tube being connected to the central body of the second side tube; each of the at least one translation means comprises a first end and a second end, the first end being connected to the engine and the second end being connected to the sleeping platform; and the sleeping platform comprises support means for bedding and at least one attachment means, each of the at least one attachment means being secured to the second end of each of the at least one translation means.

20. The system as claimed in claim 19, wherein the engine is a winch and the translation means is selected from the group consisting of wires, chains, ropes, riggings, and cables.

* * * * *